US005100718A

United States Patent [19]

Weintraub

[11] Patent Number: 5,100,718

[45] Date of Patent: Mar. 31, 1992

[54] METHOD FOR PRINTING ON FABRIC

[76] Inventor: David L. Weintraub, 72 Blackstone Ave., Binghampton, N.Y. 13903

[21] Appl. No.: 583,935

[22] Filed: Sep. 17, 1990

[51] Int. Cl.[5] ..... A32B 9/00

[52] U.S. Cl. ..... 428/195; 427/148; 427/146; 427/195

[58] Field of Search ..... 428/195; 427/148, 146, 427/195

[56] References Cited

U.S. PATENT DOCUMENTS

| | | | |
|---|---|---|---|
| 4,421,816 | 12/1983 | Arnold | 428/202 |
| 4,592,946 | 6/1986 | Shuman | 428/200 |
| 4,726,979 | 2/1988 | Chapman | 428/200 |
| 4,773,953 | 9/1988 | Hare | 156/240 |
| 4,863,781 | 9/1989 | Kronzer | 428/200 |

*Primary Examiner*—Patrick J. Ryan
*Assistant Examiner*—Kam F. Lee
*Attorney, Agent, or Firm*—Salzman & Levy

[57] ABSTRACT

There is featured a simplified, cost-reduced process for creating and applying decals to fabric materials, such as T-shirts. The invention uses conventional, non-permanent printing inks, such as oleic acid-based inks, found in typewriter and dot matrix printing ribbons. Conventional ink is injected below the surface of transfer laminate paper where it is trapped in the apertures created by the printing pins of, for example, a dot matrix printer. The design created by the injected ink is then transferred to the surface of a fabric by the application of heat, such as by use of a home iron, which causes the laminate sheet membranes to melt. As these layers melt, the ink trapped within is plasticized and the transfer process to the fabric is accomplished in the conventional manner. All types of information in the form of images, designs, characters and symbols can be injected into the laminate paper as benefits the imagination of the user.

2 Claims, 1 Drawing Sheet

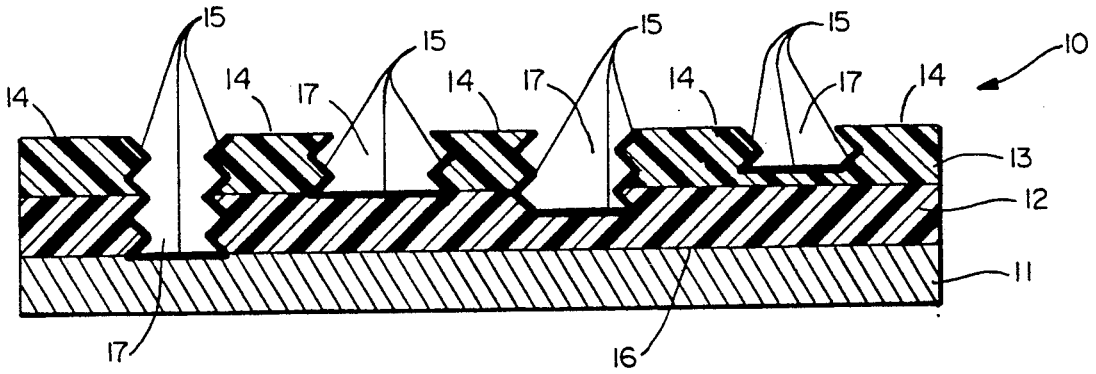
15
15
15
15
10
14
14
17
14
17
14
17
14
13
12
11
17
16

METHOD FOR PRINTING ON FABRIC

FIELD OF THE INVENTION

The invention pertains to an ink transfer method and an ink-impregnated transfer paper product for use in transferring designs to a cloth surface, such as a T-shirt, and more particularly to an ink-impregnated transfer paper and method that can transfer designs to a cloth surface without requiring the use of expensive machinery or expensive, permanent-type inks.

BACKGROUND OF THE INVENTION

The present invention relates to the transfer of ink designs to uneven surfaces, such as cloth and fabrics.

In recent times, it has become very fashionable to wear designer-type T-shirts. Many processes have been developed to transfer ink designs to the cloth surface. Among these processes are those that use transfer laminates and webs, or inks of a thermoplastic nature.

In the manufacture of the design transfer laminates, inks having a permanent binder may be used to fix the ink to the laminate surface so that the ink will not smear or smudge. Typical ink compositions for these permanent inks comprise vinyl resin, pigments and plasticizers.

Design transfer inks are expensive, and some require special machinery to apply them to the transfer medium. These inks are usually affixed to the transfer mediums by techniques such as lithography, silk screening, flexography, rotogravure, letter pressing, web-feeding and sheet feed offset methods.

Once the ink is affixed to the transfer sheet, the design can be transferred to a T-shirt easily by applying heat to the back of the sheet, as with a household iron. In fact, a substantial market in store purchased decals has been created by individuals who desire to make their own designer-type T-shirts at home. Many designs are available, but there is still a need to be able to create one's own designs.

The present invention exploits the discovery of a process by which individualized decals can be created at home without expensive machinery, and without the use of expensive inks. Even for those who still prefer to purchase decals, the inventive process has produced a cost-reduced, transfer laminate, and method of applying same.

The invention provides a simple method of applying an ordinary ink, such as a typewriter or printer ribbon ink, to a meltable laminate sheet. Using, for example, a dot matrix printer and a home computer, one can create all kinds of decals for one's own use and enjoyment.

The invention uses the discovery that ordinary, oleic acid-based inks, common to dot matrix ribbons, can be applied to meltable laminate sheets by injecting them below the surface, where they will not smudge or smear. The inks applied by a dot matrix printer are forced below the surface of the laminate sheet by the hammer force of the dot matrix pin. The ink fluid becomes trapped within a cavity created in the sheet material by the injection force of the pin. The ink remains within the pin-injected cavity by means of the capillary and surface tension forces within such a small space, which entrapment is further aided by the roughness of the pin-injected surface.

In the above manner, anybody with a PC and dot matrix printer can make his own individualized decals. All that is needed are blank transfer laminate sheets, which can be purchased at a fraction of the cost of already printed decals.

Manufacturers of pre-printed decals can likewise sell their designs at lower cost using the inventive method of ordinary ink application.

DISCUSSION OF RELATED ART

In U.S. Pat. No. 4,421,816, a process is described for printing an image on a layer of transfer paper during the manufacturing thereof.

In U.S. Pat. No. 4,592,946, a dot matrix printer and a process are shown for applying a meltable ink to a paper surface.

U.S. Pat. No. 4,726,979 describes a printed ink image that is deposited on the surface of a transfer sheet.

In U.S. Pat. No. 4,773,953, issued to Hare, a method of applying a creative design to a fabric, such as a T-shirt, is illustrated. The design is created by computer, and then printed upon a heat transfer medium, not unlike the present invention. The difference with respect to the present invention is the need to first treat the transfer surface with Singapore Dammar resin before printing the design. The design is printed on the surface of the transfer medium, whereas with the invention, the ink is injected below the surface thereof.

In U.S. Pat. No. 4,863,781, issued to Kronzer, a melt transfer web is depicted wherein the design is deposited upon the top surface of the web.

SUMMARY OF THE INVENTION

In accordance with the present invention, there is featured a simplified, cost-reduced process for creating and applying decals to fabric materials, such as T-shirts.

The invention uses conventional, non-permanent printing inks, such as oleic acid-based inks, found in typewriter and dot matrix printing ribbons.

The conventional ink is injected below the surface of the transfer laminate paper where it is trapped in the apertures created by the printing pins of, for example, a dot matrix printer. The design created by the injected ink is then transferred to the surface of a fabric by the application of heat, such as by use of a home iron. The heat of the iron causes the laminate sheet membranes to melt. As these layers melt, the ink trapped within is plasticized, and the transfer process to the fabric is accomplished in the conventional manner.

All types of information in the form of images, designs, characters, symbols, and the like can be injected into the laminate paper as befits the imagination of the user.

BRIEF DESCRIPTION OF THE DRAWINGS

A complete understanding of the present invention may be obtained by reference to the accompanying drawing, when taken in conjunction with the detailed description thereof and in which:

The FIGURE illustrates an enlarged cross-section of a transfer laminate sheet of this invention, used for applying printed decals to the surface of a fabric, such as a T-shirt, by the application of heat thereto.

DESCRIPTION OF THE PREFERRED EMBODIMENT

Generally speaking, the invention is for an ink transfer method and an ink transfer sheet product utilized to print designs and images upon fabric surfaces. The method uses conventional printing inks, such as oleic acid-based inks used to impregnate typewriter and dot matrix ribbons. Almost any ink will be useful in this invention. The ink is injected below the surface of a decal transfer laminate sheet where it is entrapped by the surface tension and capillary forces created in the small space of the dot aperture. The roughened inner surfaces of the aperture created by the sharp edges of the dot matrix pin also provide a retaining well for the entrapped ink. The entrapped ink carrying the design to be transferred to the fabric is released and melds with the plasticizer in the laminate sheet upon application of heat from a home iron. In this manner, the ink is deposited to the fabric surface in the standard fashion.

Now referring to the FIGURE, an enlarged cross-section of a heat-activated, transfer laminate sheet 10 is illustrated.

The transfer laminate sheet 10 can be a commercially available transfer sheet, such as a web sold under the tradename of "Trans-Eze," manufactured by the Kimberly Clark Company and described in U.S. Pat. No. 4,863,781, issued to Kronzer. Such a sheet generally contains a non-transfer paper backing 11, upon which is layered a conformable layer 12, and further upon which is layered a release layer 13.

The method of the invention injects a conventional ink, not containing plasticizer, below the transfer surface 14 of the web 10, as shown. The ink can be injected by the pins of a dot matrix printer, thus allowing an individual at home to print his own designs utilizing a conventional PC in conjunction therewith.

As can be observed from the FIGURE, the pins can provide different depths of penetration into the laminate layers 12 and 13, respectively, all the way to the surface 16 of the transfer backing 11. The ink from the printing pins deposits a thin surface coated ink layer 15 on the rough or jagged surface of the print hole apertures 17, as shown. The ink is trapped within the layers by means of the surface tension and capillary action associated with such small aperture space, and further by way of the roughened surfaces created by the sharp pins of the matrix printer. The non-permanent ink, so trapped, will not suffer from the usual rubbing off of the web 10, as would occur if it were merely deposited upon the transfer surface 14.

Having retained the print design within the transfer laminate sheet 10, the transfer surface 14 is laid upon the fabric to be printed, and a heated iron is applied to the non-transfer backing 11 in the usual manner. The heat of the iron will then melt the plasticizer in the laminate layers of the web 10.

The ink trapped in apertures 17 will meld with the melting plasticizer in the laminate layers, thus causing the ink and plasticizer to flow together onto the fabric, consequently transferring the design thereto.

The laminate paper can be made specially for dot matrix printers by fabricating the transfer paper with side sprocket holes, and vertical or horizontal perforations as are well known in the art, if desired.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A transfer medium for transferring ink to a surface for receiving ink, said surface being disposed upon a fabric disposed contiguous of said transfer medium, said transfer medium comprising:

a source of ink for transfer to said surface of said fabric, said ink being substantially free of a plasticizing substance, but capable of melding with a plasticizer material contained within a transfer medium upon the application of heat to said plasticizer material;

a transfer medium having a transfer surface for contact with the surface of said fabric, said transfer medium being of a laminate construction comprising at least one layer containing a plasticizer, said plasticizer being meltable with the application of heat, and a non-transfer backing disposed adjacent to said at least one layer, said non-transfer backing being substantially free of meltable plasticizer; and means defining a plurality of tiny apertures disposed in said transfer medium that extend below said transfer surface of said transfer medium and into said at least one layer of said laminate construction, said means containing said source of ink for coating said at least one layer of said laminate construction with said ink, within said plurality of tiny apertures, whereby said plasticizer contained in at least one layer of said transfer medium adjacent said non-transfer backing will be caused to melt and meld with said ink coated upon said at least one layer of said laminate construction within said tiny apertures upon the application of heat, wherein ink will be transferred to said surface of said fabric contiguous with said transfer medium.

2. The transfer medium for transferring ink to a surface of a fabric in accordance with claim 1, wherein said means defining a plurality of tiny apertures form a design.

* * * * *